US006454322B1

(12) United States Patent
Su

(10) Patent No.: US 6,454,322 B1
(45) Date of Patent: Sep. 24, 2002

(54) DOOR LOCK SET OPTIONALLY SATISFYING EITHER LEFT-SIDE LATCH OR RIGHT-SIDE LATCH

(76) Inventor: Frank Su, No. 26, Lane 143, Hsin-Sheng S. Road, Sec. 1, Taipei (TW)

( * ) Notice: Subject to any disclaimer, the term of this patent is extended or adjusted under 35 U.S.C. 154(b) by 9 days.

(21) Appl. No.: 09/667,640

(22) Filed: Sep. 21, 2000

(51) Int. Cl.[7] ..... E05B 15/10; E05B 17/00
(52) U.S. Cl. ..... 292/244; 70/462
(58) Field of Search ..... 292/244; 70/461, 70/462, 107

(56) References Cited

U.S. PATENT DOCUMENTS 3,390,558 A * 7/1968 Tornoe et al. ..... 70/107
4,809,526 A * 3/1989 Shen ..... 70/107
4,864,835 A * 9/1989 Wartian ..... 70/107
4,995,248 A * 2/1991 Liu ..... 70/107
5,077,992 A * 1/1992 Su ..... 70/107

FOREIGN PATENT DOCUMENTS

FR 2493896 * 5/1982 ..... 70/462

* cited by examiner

*Primary Examiner*—Suzanne Dino Barrett
*Assistant Examiner*—John B. Walsh

(57) ABSTRACT

A door lock set includes: a housing fixed on a door; an upper cam rotatably mounted on an upper portion of the housing and operatively retracting an upper latch; a lower cam rotatably mounted on a lower portion of the housing and operatively retracting a lower latch; a first linking rod and a second linking rod juxtapositionally pivotally secured between the upper cam and the lower cam and respectively disposed on a left side and a right side of the two cams; whereby upon a clockwise rotation of either cam, each latch provided on a right side of the door will be retracted; while upon a counterclockwise rotation of the cam, the latch provided on a left side of the door will be retracted, thereby optionally satisfying any door latch regardless of its right side position or left side position.

4 Claims, 5 Drawing Sheets

DOOR LOCK SET OPTIONALLY SATISFYING EITHER LEFT-SIDE LATCH OR RIGHT-SIDE LATCH

BACKGROUND OF THE INVENTION

U.S. Pat. No. 5,077,992 issued to the same inventor of this application disclosed a door lock set including a driving cam operatively retracting a latch, a follower cam operatively retracting a dead bolt, and a linking rod pivotally connecting the driving cam with the follower cam for a simultaneous retraction of the latch and the dead bolt.

However, such a prior art may only be provided for a single side latch or dead bolt. For example, if the linking rod is pivotally secured on a right side of the cam, it may only be suitable for retracting a dead bolt or a latch installed on a right side of the door. It may cause confusion or inconvenience for the end user of the door lock set since he or she should clearly distinguish whether the door lock set is adapted for a latch (or dead bolt) at a right side or a left side.

The present inventor has found this drawback and invented the door lock set which may be suitable either for a left-side latch or a right-side latch.

SUMMARY OF THE INVENTION

The object of the present invention is to provide a door lock set including: a housing fixed on a door; an upper cam rotatably mounted on an upper portion of the housing and operatively retracting an upper latch; a lower cam rotatably mounted on a lower portion of the housing and operatively retracting a lower latch; a first linking rod and a second linking rod juxtapositionally pivotally secured between the upper cam and the lower cam and respectively disposed on a left side and a right side of the two cams; whereby upon a clockwise rotation of either cam, each latch provided on a right side of the door will be retracted; while upon a counterclockwise rotation of the cam, the latch provided on a left side of the door will be retracted, thereby optionally satisfying any door latch regardless of its right side position or left side position.

DETAILED DESCRIPTION

Figure 1:
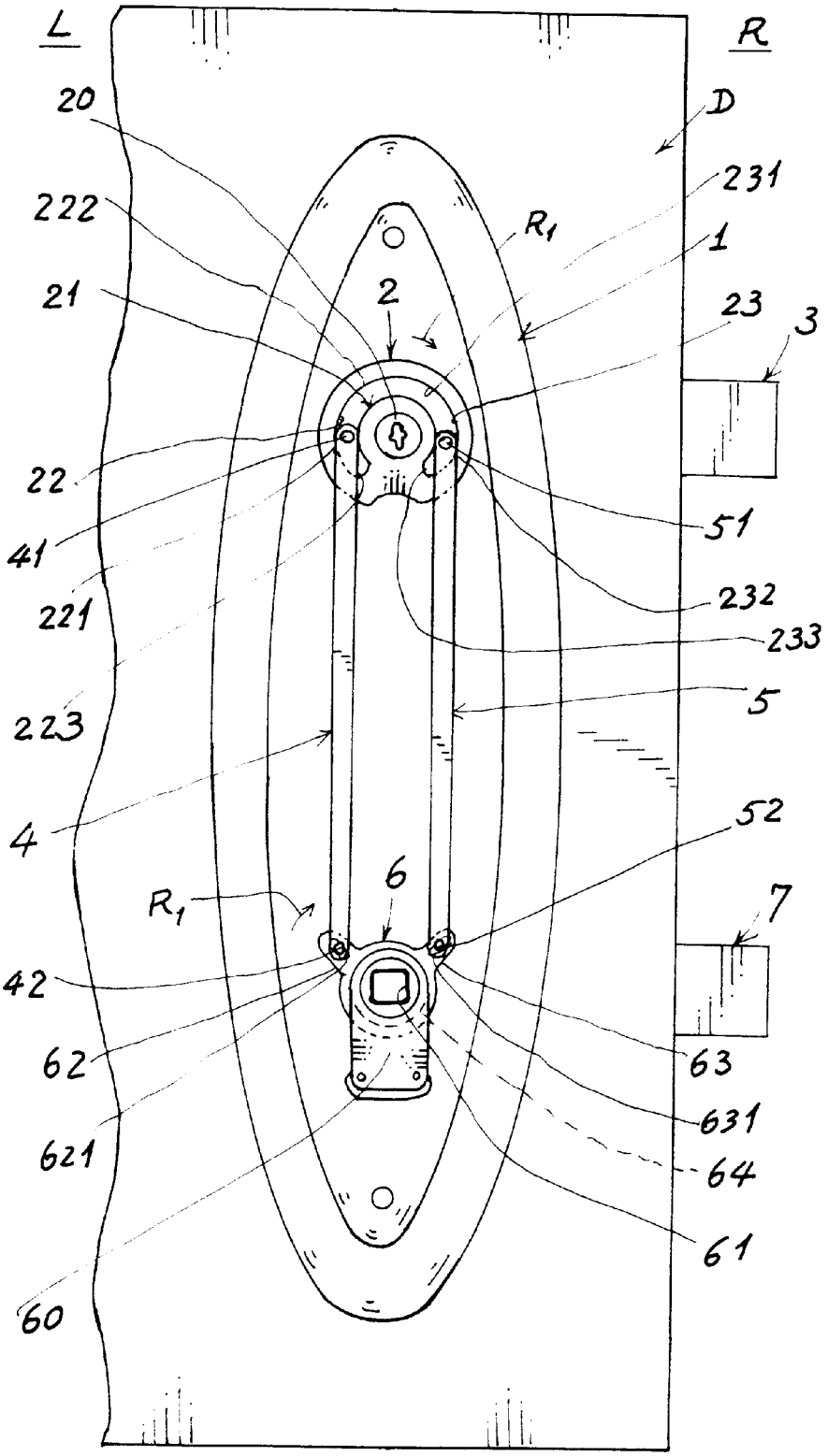
FIG. 1 is an illustration of the present invention when the latches are rightwardly protruded.

As shown in the drawing figures, the door lock set of the present invention comprises: a housing 1, an upper cam 2 operatively retracting an upper latch 3 provided on an upper portion of a door D, a first linking rod 4 and a second linking rod 5 juxtapositionally secured in the housing 1, and a lower cam 6 operatively retracting a lower latch 7 provided on a lower portion of the door D.

The upper cam 2 includes a spindle 20 rotatably mounted in an upper portion of the housing 1, a C-shaped arcuate slot

21 arcuately formed in the upper cam 2 having a left arcuate slot portion 22 formed on a left portion of the C-shaped arcuate slot 21 for slidably engaging an upper pin 41 of the first linking rod 4 and having a right arcuate slot portion 23 formed on a right portion of the C-shaped arcuate slot 21 for slidably engaging an upper pin 51 of the second linking rod 5.

The left arcuate slot portion 22 (FIGS. 1, 3) includes a lower arcuate thrusting surface 221 formed on a lower edge portion of the left arcuate slot portion 22, an upper arcuate thrusting surface 222 formed on an upper edge portion of the left arcuate slot portion 22, and a left slot end portion 223 formed on a lowest edge portion of the left arcuate slot portion 22.

The right arcuate slot portion 23 includes an upper arcuate thrusting surface 231 formed on an upper edge portion of the right arcuate slot portion 23, a lower arcuate thrusting surface 232 formed on a lower edge portion of the right arcuate slot portion 23, and a right slot end portion 233 formed on a lowest edge portion of the right arcuate slot portion 23.

The lower cam 6 includes a spindle 61 rotatably mounted in a holding plate 60 secured on a lower portion of the housing 1 as resiliently cushioned by a coiled spring 64 retained between the lower cam 6 and the housing 1, a left lug 62 radially protruding leftwardly from the lower cam 6 having a pin slot 621 formed in the left lug 62 for slidably engaging a lower pin 42 of the first linking rod 4, and a right lug 63 radially protruding rightwardly from the lower cam 6 having a pin slot 631 formed in the right lug 63 for slidably engaging a lower pin 52 of the second linking rod 5.

Figure 2:
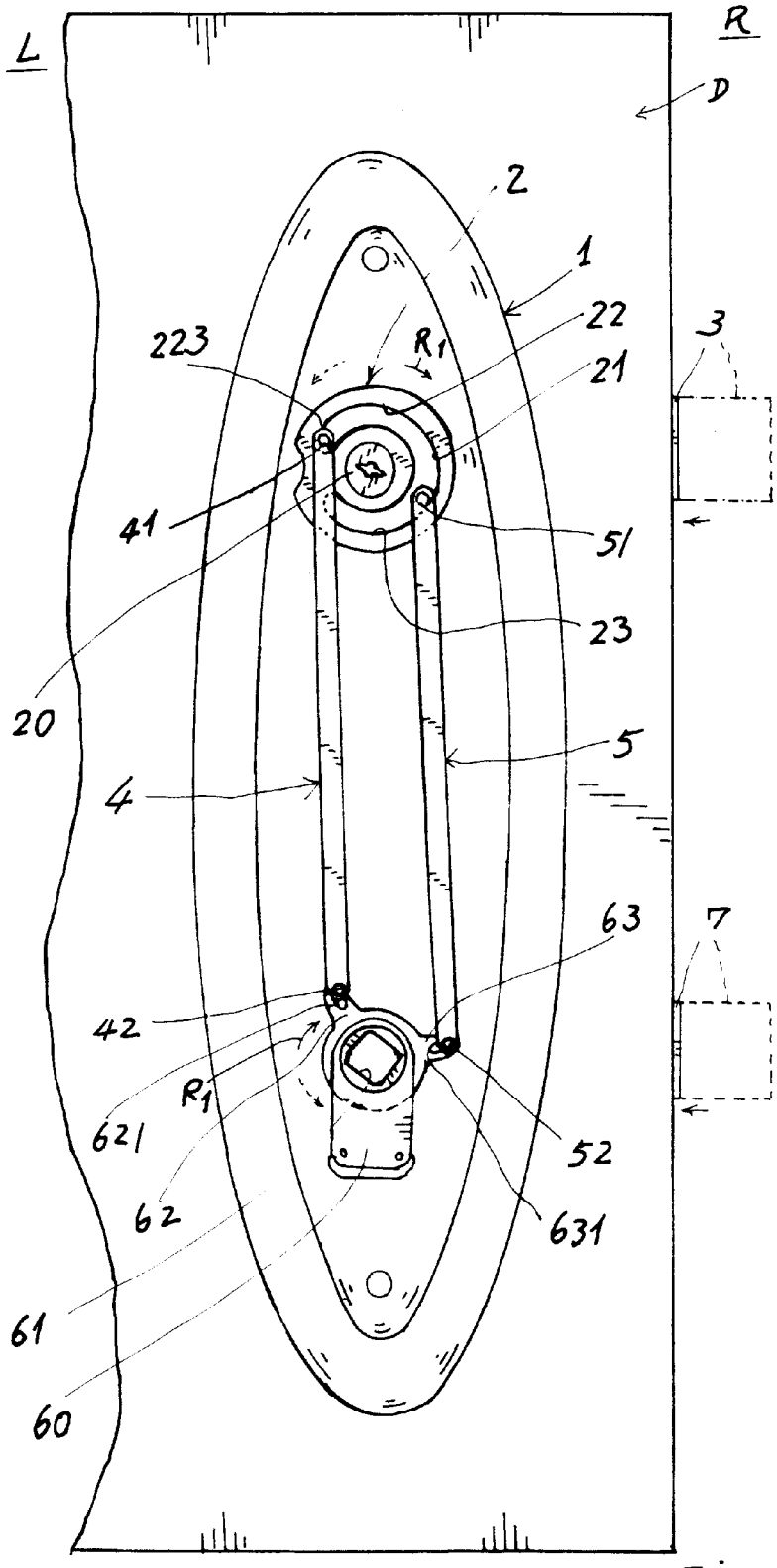
FIG. 2 is an illustration showing a retraction of the latches after a clockwise rotation of the cam from FIG. 1

Each cam 2 or 6 may be connected with a latch driving mechanism (not shown) in order to operatively retract the latch 3 or 7. In FIGS. 1, 2, there is showing a door D having the latches 3, 7 provided at the right side R of the door. While as shown in FIGS. 3, 4, the latches 3, 7 are provided at a left side L of the door D.

As shown in FIGS. 1, 2, when the upper cam 2 is rotated clockwise R1, the upper latch 3 will be retracted inwardly into the door and the lower arcuate thrusting surface 221 of the C-shaped arcuate slot 21 will urge the upper pin 41 of the first linking rod 4 upwardly to allow the lower pin 42 of the first linking rod 4 to pull the left lug 62 of the lower cam 6 upwardly; and the upper arcuate thrusting surface 231 of the right arcuate slot portion 23 will drive the upper pin 51 of the second linking rod 5 downwardly to allow the lower pin 52 of the second linking rod 5 to urge the right lug 63 of the lower cam 6 downwardly, thereby simultaneously rotating the lower cam clockwise (R1) to retract the lower latch 7 (FIG. 2).

When the first linking rod 4 is moved upwardly and the second linking rod 5 is moved downwardly as shown in FIG. 2, the upper pin 41 of the first rod 4 is engaged with the left slot end portion 223 of the left arcuate slot portion 22 of the C-shaped slot 21, a counterclockwise rotation (as dotted line shown in FIG. 2) of the upper cam 2 will allow the arcuate slot 21 to drive the two rods 5, 4 to pull the right lug 63 upwardly and to push the left lug 62 downwardly, thereby also rotating the lower cam 6 counterclockwise (dotted line) to restore the two cams 2, 6 as shown in FIG. 1, and also to protrude the latches 3, 7 outwardly.

Figure 3:
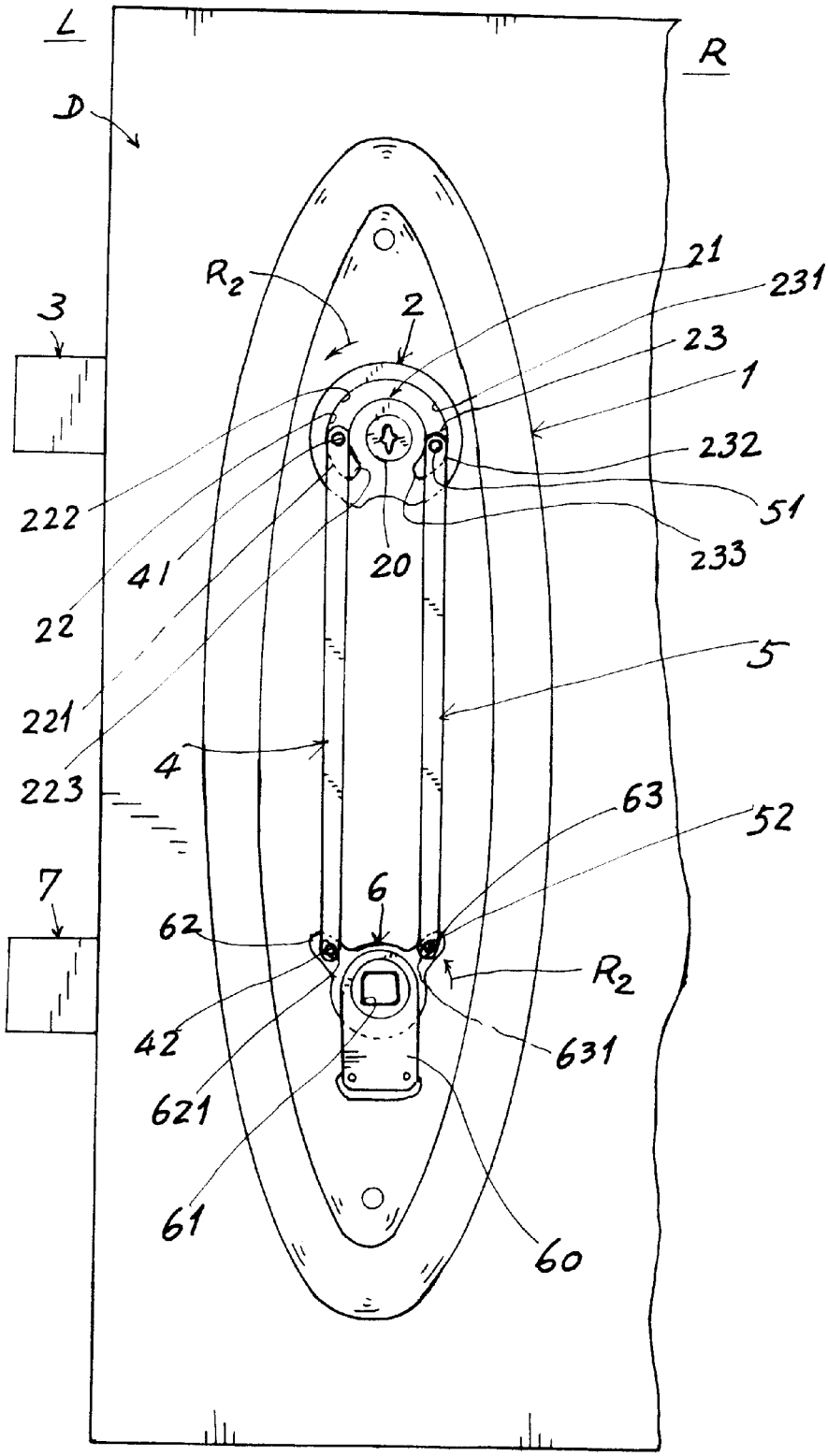
FIG. 3 is an illustration of the present invention when the latches are leftwardly protruded.
Figure 4:
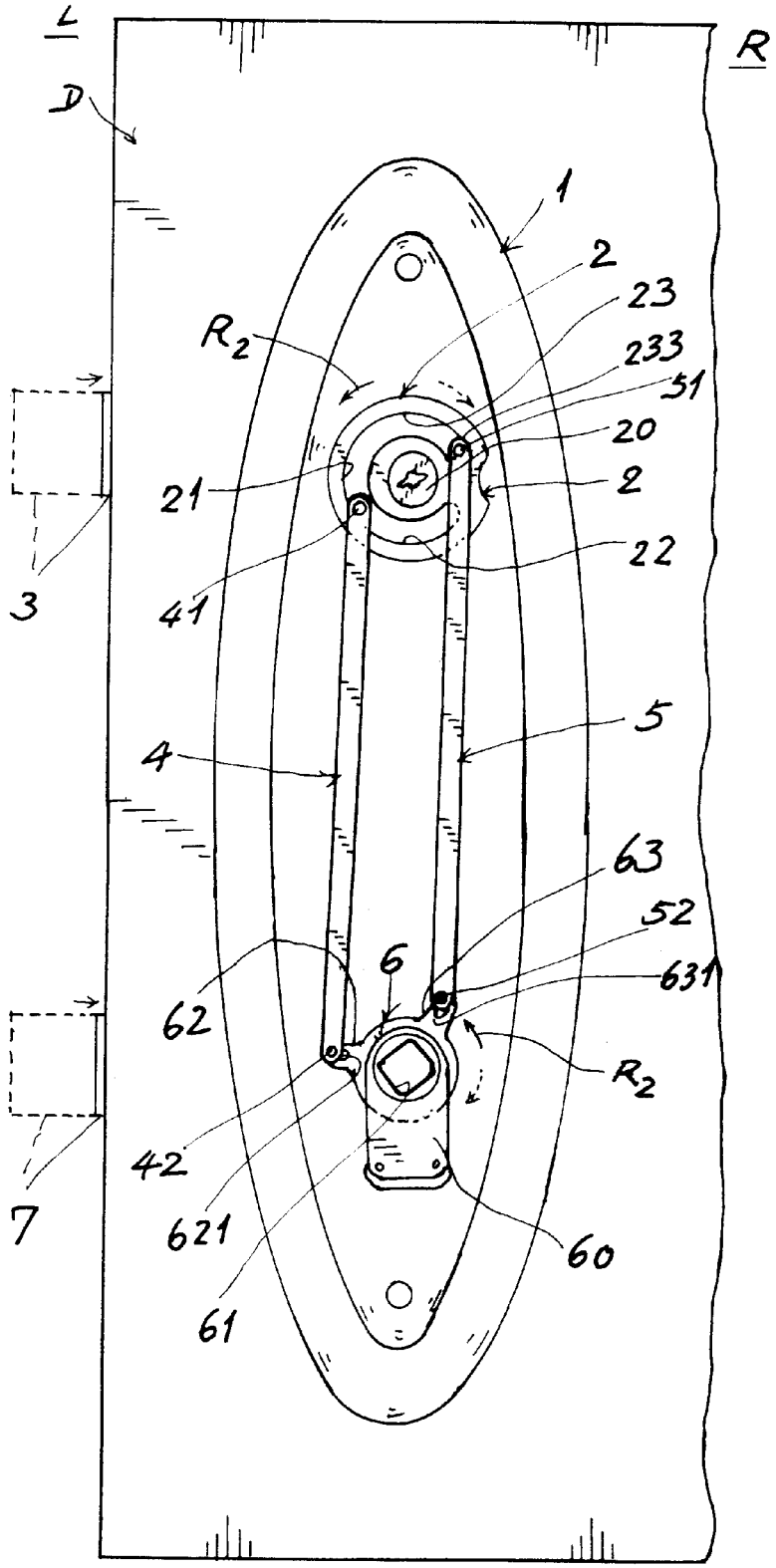
FIG. 4 is an illustration showing a retraction of the latches after a counterclockwise rotation of the cam from FIG. 3.
Figure 5:
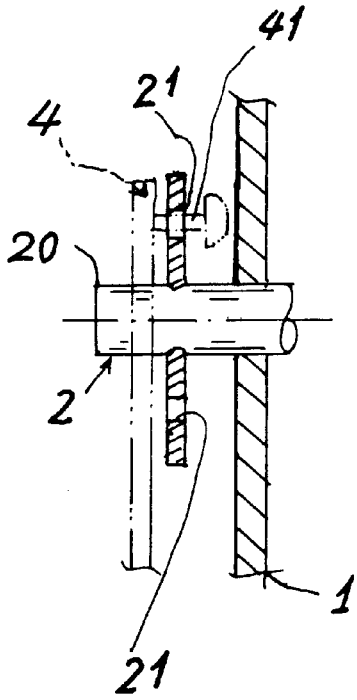
FIG. 5 is a partial sectional drawing of the upper cam of the present invention.
Figure 6:
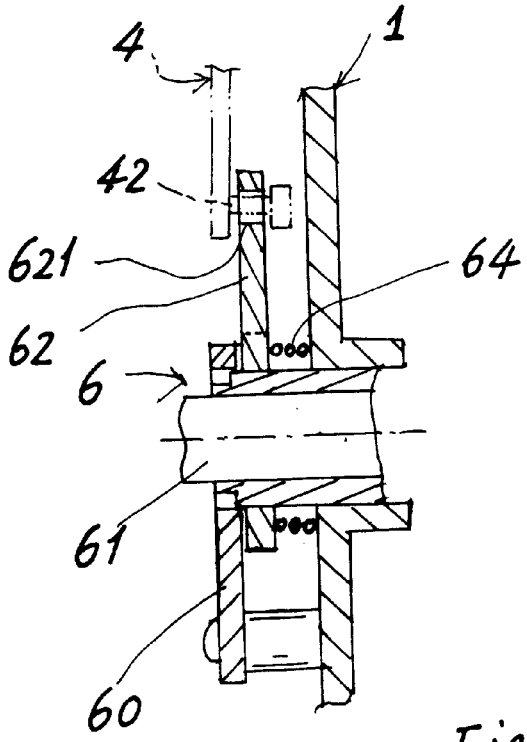
FIG. 6 is a partial sectional drawing of the low cam of the present invention.

As shown in FIGS. 3, 4, when the upper cam 2 is rotated counter clockwise R2, the upper latch 3 will be retracted inwardly into the door and the upper arcuate thrusting surface 221 of the C-shaped arcuate slot 21 will urge the upper pin 41 of the first linking rod 4 downwardly to allow the lower pin 42 of the first linking rod 4 to push the left lug 62 of the lower cam 6 downwardly; and the lower arcuate thrusting surface 232 of the right arcuate slot portion 23 will drive the upper pin 51 of the second linking rod S upwardly to allow the lower pin 52 of the second linking rod 5 to pull the right lug 63 of the lower cam 6 upwardly, thereby simultaneously rotating the lower cam clockwise (R2) to retract the lower latch 7 (FIG. 4).

When the first linking rod 4 is moved downwardly and the second linking rod 5 is moved upwardly as shown in FIG. 4, the upper pin 51 of the second rod 5 is engaged with the right slot end portion 233 of the right arcuate slot portion 23 of the C-shaped slot 21, a clockwise rotation (as dotted line shown in FIG. 4) of the upper cam 2 will allow the arcuate slot 21 to drive the two rods 5, 4 to pull the left lug 62 upwardly and to push the right lug 63 downwardly, thereby also rotating the lower cam 6 clockwise (dotted line) to restore the two cams 2, 6 as shown in FIG. 3, and also to protrude the latches 3, 7 outwardly.

Accordingly, this invention may be suitable for a door having its latches 3, 7 formed on either a right side of the door (FIGS. 1, 2) or a left side of the door (FIGS. 3, 4). The end user or the buyer of the door lock set of the present invention will not care the right or left position of the latches for a convenient installation of the door equipments, without confusion.

The present invention may be modified without departing from the spirit and scope of the present invention.

The end portion 223 or 233 of the slot portion 22, 23 will serve as a stopper for limiting the utmost upward movement of either linking rod 4 or 5 (FIGS. 2, 4).

The shapes of the relevant elements of the present invention are not limited and may be modified or varied by those skilled in the art.

The clockwise rotation (R1) of the lower cam 6 will retract the lower latch 7 and to drive the two rods 4, 5 to also rotate the upper cam 2 clockwise, thereby simultaneously retracting the upper latch 3 as shown in FIGS. 1, 2.

While the counterclockwise rotation (R2) of the lower cam 6 will retract the lower latch 7 and to drive the two rods 5, 4 to also rotate the upper cam 2 counterclockwise (R2) to retract the upper latch (3) simultaneously (FIGS. 3, 4).

I claim:

1. A door lock set comprising:

a housing (1) fixed on a door;

an upper cam (2) rotatably mounted on an upper portion of the housing and operatively retracting an upper latch (3) into the door for opening the door; said upper cam (2) including a spindle (20) rotatably mounted in an upper portion of the housing (1), a C-shaped arcuate slot (21) arcuately formed in the upper cam (2) having a left arcuate slot portion (22) formed on a left portion of the C-shaped arcuate slot (21) for slidably engaging an upper pin (41) of a first linking rod (4) and having a right arcuate slot portion (23) formed on a right portion of the C-shaped arcuate slot (21) for slidably engaging an upper pin (51) of a second linking rod (5);

a lower cam (6) rotatably mounted on a lower portion of the housing and operatively retracting a lower latch (7) into the door for opening the door;

the first linking rod (4) and the second linking rod (5) juxtapositionally pivotally secured between said upper cam (2) and said lower cam (6), and respectively disposed on a left side and a right side of said two cams (2, 6), whereby when providing said latches (3, 7) at a right side of the door and upon a clockwise rotation of said cams (2, 6), said latches (3, 7) will be retracted;

and when providing said latches (3, 7) at a left side of the door and upon a counterclockwise rotation of said cams, said latches will be retracted, thereby providing a door lock set regardless of a right side or left side position of said latches.

2. A door lock set according to claim 1, wherein said left arcuate slot portion (22) includes a lower arcuate thrusting surface (221) formed on a lower edge portion of the left arcuate slot portion (22), an upper arcuate thrusting surface (222) formed on an upper edge portion of the left arcuate slot portion (22), and a left slot end portion (223) formed on a lowest edge portion of the left arcuate slot portion (22).

3. A door lock set according to claim 1, wherein said right arcuate slot portion (23) includes an upper arcuate thrusting surface (231) formed on an upper edge portion of the right arcuate slot portion (23), a lower arcuate thrusting surface (232) formed on a lower edge portion of the right arcuate slot portion (23), and a right slot end portion (233) formed on a lowest edge portion of the right arcuate slot portion (23).

4. A door lock set according to claim 1, wherein said lower cam (6) includes a spindle (61) rotatably mounted in a holding plate (60) secured on a lower portion of the housing (1) as resiliently cushioned by a coiled spring (64) retained between the lower cam (6) and the housing (1), a left lug (62) radially protruding leftwardly from the lower cam (6) having a pin slot (621) formed in the left lug (62) for slidably engaging a lower pin (42) of the first linking rod (4), and a right lug (63) radially protruding rightwardly from the lower cam (6) having a pin slot (631) formed in the right lug (63) for slidably engaging a lower pin (52) of the second linking rod (5).

* * * * *